11/10/87 OR 4,706,094

United States Patent [19]

Kubick

[11] Patent Number: 4,706,094

[45] Date of Patent: Nov. 10, 1987

[54] ELECTRO-OPTIC BEAM SCANNER

[75] Inventor: Frederick Kubick, Redding, Conn.

[73] Assignee: United Technologies Corporation, Hartford, Conn.

[21] Appl. No.: 730,401

[22] Filed: May 3, 1985

[51] Int. Cl.[4] ..... H01Q 19/06; H01Q 15/02

[52] U.S. Cl. ..... 343/754; 343/753; 343/772; 343/909; 350/355

[58] Field of Search ..... 343/753–756, 343/772, 783, 909, , 910, 911 R, 911 L, 912; 350/355, 374, 380, 381, 384, 389, 393–395, 372, 396

[56] References Cited

U.S. PATENT DOCUMENTS

| | | | |
|---|---|---|---|
| 2,591,701 | 4/1952 | Jaffe | 350/389 |
| 2,600,962 | 6/1952 | Billings | 350/372 |
| 2,939,142 | 5/1960 | Fernsler | 343/754 |
| 3,257,608 | 6/1966 | Bell et al. | 350/396 |
| 3,334,958 | 8/1967 | Appeldorn | 350/452 |
| 3,369,242 | 2/1968 | Johnson | 343/754 |
| 3,393,034 | 7/1968 | Imai | 350/260 |
| 3,445,851 | 5/1969 | Sheldon | 343/754 |
| 3,499,701 | 3/1970 | Macek et al. | 350/380 |
| 3,503,670 | 3/1970 | Kosanke et al. | 350/394 |
| 3,507,550 | 4/1970 | Harris et al. | 350/393 |
| 3,513,323 | 5/1970 | Sincerbox et al. | 350/382 |
| 3,522,985 | 8/1970 | Rogers | 350/402 |
| 3,528,723 | 9/1970 | Rogers | 350/403 |
| 3,555,987 | 1/1971 | Browning | 350/384 |
| 3,558,215 | 1/1971 | DeLang et al. | 350/388 |
| 3,574,441 | 4/1971 | Harris et al. | 350/390 |
| 3,575,487 | 4/1971 | Ohm et al. | 350/383 |
| 3,575,488 | 4/1971 | Ohm et al. | 350/383 |
| 3,623,795 | 11/1971 | Taylor et al. | 350/380 |
| 3,631,501 | 12/1971 | Buscher | 343/754 |
| 3,744,875 | 7/1973 | Haertling et al. | 350/389 |
| 3,781,086 | 12/1973 | Kumada et al. | 350/374 |
| 3,809,461 | 5/1974 | Baumgardner et al. | 350/302 |
| 3,868,172 | 2/1975 | Ii et al. | 350/358 |
| 3,938,878 | 2/1976 | Fox | 350/389 |
| 4,129,357 | 12/1978 | Frosch et al. | 350/403 |
| 4,154,505 | 5/1979 | Kato et al. | 350/374 |
| 4,197,008 | 4/1980 | Pinnow et al. | 356/150 |
| 4,201,450 | 5/1980 | Trapani | 350/374 |
| 4,222,638 | 9/1980 | Robert | 350/96.14 |
| 4,229,073 | 10/1980 | Lotspeich | 350/374 |
| 4,323,901 | 4/1982 | De Wames et al. | 343/754 |
| 4,327,971 | 5/1982 | Kondo et al. | 350/388 |

OTHER PUBLICATIONS

M. B. Klein, *Dielectric Waveguide Modulators at* 95 *GHz Using LiNb*01(*), International Journal of Infrared and Millimeter Waves, vol. 3, No. 5 (1982).

M. B. Klein, *Phase Shifting at* 94 *GHz Using the Electro-Optic Effect in Bulk Crystals,* International Journal of Infrared and Millimeter Waves, vol. 2, No. 2 (1981).

Cecil E. Land and Philip D. Thacher, *Ferroelectric Ceramic Electrooptic Materials and Devices,* Proceedings of the IEEE, vol. 57, No. 5, May 1969.

*Primary Examiner*—Marvin L. Nussbaum

[57] ABSTRACT

A scanner (13) of ferroelectric material (17) for redirecting the orientation of a beam (22) of millimeter wavelength radiation. The scanner (13) includes parallel input and output sides with matching layers (44). Adjacent and opposite parallel wire grid electrodes (31') are addressed with progressive voltage difference excitation levels across the face of the ferroelectric material in order progressively to modify the refractive index distribution of the scanner and thereby conduct effective beam steering.

4 Claims, 9 Drawing Figures

ELECTRO-OPTIC BEAM SCANNER

DESCRIPTION

1. Technical Field

The invention herein deals with the technology of radars and more particularly to the application of ferroelectric materials and their electro-optic properties to beam scanning in radar systems, especially those operating at millimeter wavelengths.

2. Background Art

Ferroelectric materials have become well known since the discovery of Rochelle salt for their properties of spontaneous polarization and hysteresis. See the *International Dictionary of Physics and Electronics,* D. Van Nostrand Company Inc., Princeton (1956). Other ferroelectrics including barium titanate have also become familiar subjects of research.

However, the application of the properties of ferroelectric materials to millimeter wavelength devices and radar systems is largely uncharted scientific terrain, especially with respect to scanning devices.

At millimeter wavelengths, moreover, standard microwave practice is hampered by the small dimensions of the working components, such as waveguides and resonant structures. Furthermore, there is a considerable lack of suitable materials from which to make components. Even beyond this, the manufacturing precision demanded by the small dimensions of the components, makes their construction difficult and expensive.

Ferroelectric materials are accordingly of particular interest in making scanning devices, because certain of their dielectric properties change under the influence of an electric field. In particular, an "electro-optic" effect can be produced by the application of a suitable electric field.

As is well known, ferroelectric materials are substances having a non-zero electric dipole moment in the absence of an applied electric field. They are frequently regarded as spontaneously polarized materials for this reason. Many of their properties are analogous to those of ferromagnetic materials, although the molecular mechanism involved has been shown to be different. Nonetheless, the division of the spontaneous polarization into distinct domains is an example of a property exhibited by both ferromagnetic and ferroelectric materials.

A suitably oriented birefringent medium changes the propagation conditions of passing radiation. An electric field may change the refractive index of the medium, thereby altering said propagation conditions, and thus establishing a variable phase shift in the passing radiation. This change in refractive index is considered an electro-optic effect.

The propagation change due to the refractive index change can be understood as follows. Radiation in the millimeter wavelength domain divides into components upon incidence with a ferroelectric medium having a suitably aligned optic axis. One component exhibits polarization which is perpendicular to the optic axis (the ordinary ray), and the other component exhibits polarization orthogonal to that of the first, and is parallel to the optic axis (the extraordinary ray). The refractive indices of the ferroelectric material, respectively $n_o$ and $n_e$, determine the different speeds of propagation.

The induced phase shift of passing radiation can be changed by electro-optically varying the refractive indices of the medium. This can be done by applying a sustained electric field of sufficient magnitude in the appropriate direction. The electric field typically changes the refractive indices, $n_o$ and $n_e$ by different amounts.

Despite common knowledge of the above information, the contribution of these characteristics of ferroelectric materials to the effective operation of electro-optic scanners and their control of the direction of millimeter wavelength propagation is considered to be novel and inventive, as disclosed below.

BRIEF DESCRIPTION OF THE INVENTION

According to the invention addressed herein, a selected monolithic block of ferroelectric material is disposed in the path of a beam of millimeter wavelength radiation. A pair of parallel wire electrodes straddle opposite sides of the monolithic block of ferroelectric material. The electrodes include parallel wires which are provided with spatially ascending or descending electric field or voltage levels, over predetermined zones on the face of said monolithic block. In this fashion, the electrodes are effective for inducing a spatially varying phase shift in the passing millimeter wavelength radiation, by means of the predetermined electric field pattern established across the wire grid electrodes of the scanner device. As a result, the controllable alteration of the direction of the beam of radiation is accomplished. The phase shift effective to redirect the beam is produced by the change in the propagation constants of the ferroelectric medium, i.e. the refractive indices, resulting from the applied electric field.

According to the invention, the steering of a millimeter wavelength radar beam over a significant angular range is thus performed electronically.

DETAILED DESCRIPTION OF A PREFERRED MODE

Figure 1:
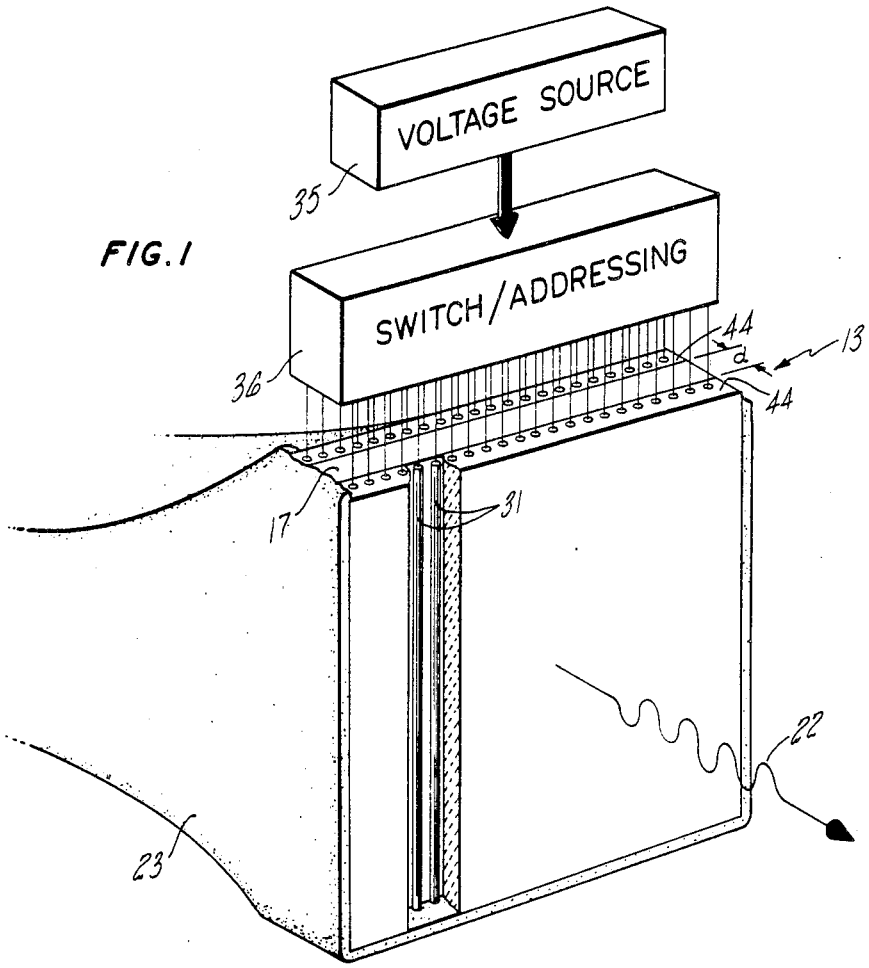
FIG. 1 is an isometric view of a block of ferroelectric material including matching layers and straddling grid electrodes in accordance with the invention herein.

FIG. 1 shows the basic configuration of an electro-optic phased array beam scanner 13 of ferroelectric material 17, according to the invention herein for diverting the direction of a beam 22 of millimeter wavelength radiation produced in horn 23. The scanner 13 includes an active medium such as, for example, a monolithic block of ferroelectric material 17 such as barium titanate in single crystal or in fine-grained random polycrystalline or ceramic form, for example, for insertion over a horn 23 or other aperture of a radar system (not shown). Prior art beam steerers are not known to be monolithic. Their development is considered novel and considerably advantageous in terms of ease of manufacture and handling.

The ferroelectric material 17 intercepts the beam 22 of millimeter wavelength electromagnetic radiation for redirection as will be shown. In particular, the ferroelectric material 17 is distributed over the aperture of horn 23 in the form of a planar layer of substantially uniform thickness "d". The thickness is selected to be sufficient to establish at least a single wavelength or two "pi" radian phase delay under a selected electric field excitation level. According to one version of the invention, the ferroelectric material 17 is rectangular in form.

On each side of the monolithic block of ferroelectric material 17, there are disposed first and second parallel wire electrodes 31' each including independently addressable parallel wires 31. The parallel wire electrodes 31' which serve as oppositely disposed and straddling electrode grids for applying spatially varying selectable levels of electric field excitation in order to modify the local refractive indices, i.e. $n_o$ and $n_e$, within refractive material 17. During operation, as will be seen, the wires 31 in these parallel wire grid electrodes 31' are individually excited by voltage source 35 operating through a well-known switch/addressing scheme 36 to establish desired excitation levels over the face of material 17. This scheme 36 provides a sustained voltage distribution to wires 31 to one or more predetermined adjacent zones, established by selecting a beam steerage direction and the area of said ferroelectric material required to steer the beam by that selected angle. The sustained voltage distribution is a distribution of ascending or descending voltage differences between corresponding or opposite wires 31 of electrodes 31'.

Application of such a sustained voltage distribution permits one-dimensional or lengthwise variations in the electric field profile applied across the face of radar aperture 21. The scheme 36 may be used to establish a straight line diminishing or ascending voltage pattern, by using parallel ascending resistors (not shown) in series with voltage source 35. The induced phase shifts thus established cause the radar beam 22 to change direction in a manner to be described. In principal, the operation of the scanner is thus similar to that of phased array radar antennas.

Material 17 is initially c-poled, according to a preferred embodiment, establishing a domain orientation thereof parallel to the direction of propagation.

The scanner 13 further includes two impedance matching layers 44 on opposite sides of the ferroelectric material 17, which in effect thereby straddle the ferroelectric material 17. These layers reduce the reflective losses which would otherwise impede performance, in view of the very high refractive indices characterizing ferroelectric materials, as is well known. The matching layers 44 are suitably deposited, for example, upon the flat surfaces of the ferroelectric material 17 by well known vacuum deposit techniques, for example, or by cementing or pressing into place prefabricated thin layers or sheets of a suitable dielectric material which is effective for proper matching of the input and output sides of the ferroelectric material 17. In lieu of a single matching layer 44, several layers can be substituted. If different kinds of dielectric material are used, as is well known, the device bandwidth can be enhanced.

Figure 2A:
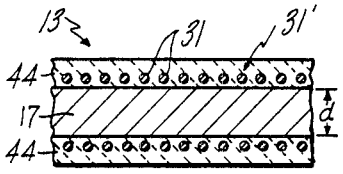
FIGS. 2A–2C respectively are partial cross sections of three variations in carrying out the invention, FIG. 2A thereof indicating the wires of the parallel wire electrodes immediately adjacent the ferroelectric material, FIG. 2B showing the grid wires outside both the matching layers and the ferroelectric material, and FIG. 2C showing the grid wires relatively far removed from the ferroelectric material.
Figure 2B:
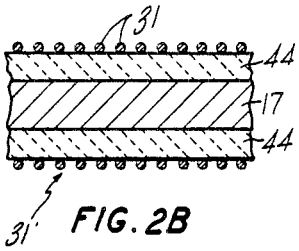
Figure 2C:
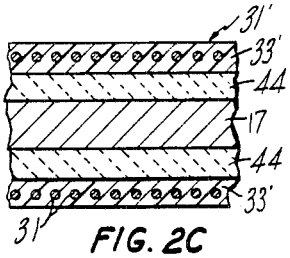
Figure 3A:
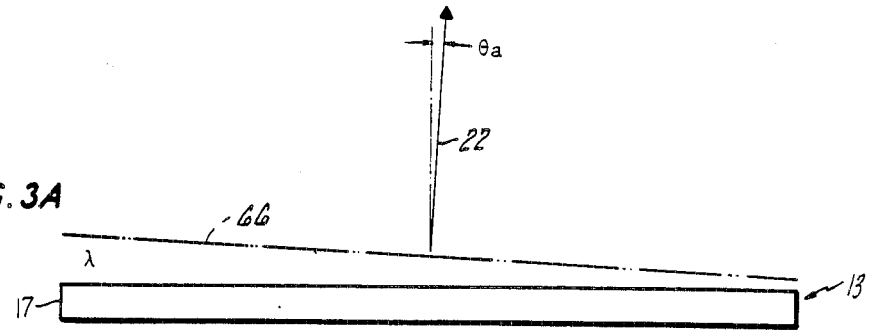
FIGS. 3A–3D show redirected wavefronts of millimeter wavelength radiation in which the ferroelectric material has been suitably electrically field excited to establish a redirected wavefront of radiation deviating from its former direction by respectively: no more than a first angular amount not requiring any transition areas in said ferroelectric material, no more than a second angular amount requiring for example two transition areas therein, no more than a third angular amount requiring for example four transition areas, and no more than a fourth angular amount requiring six transition zones.
Figure 3B:
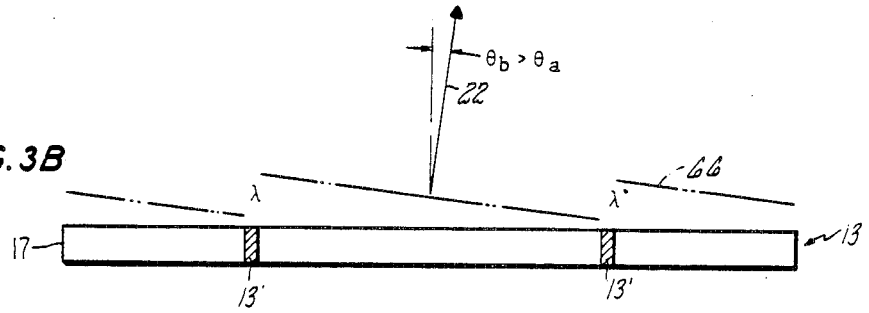
Figure 3C:
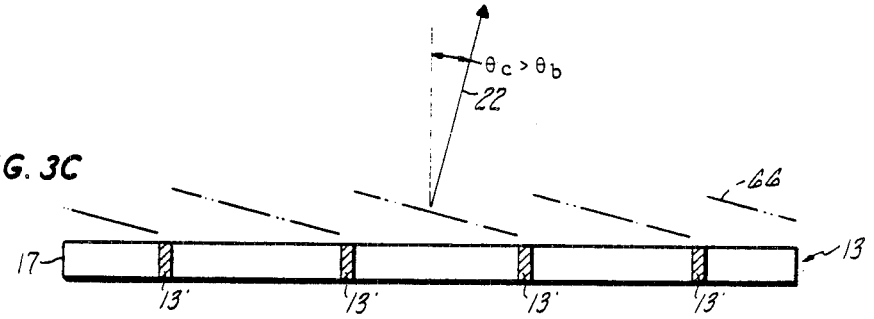
Figure 3D:
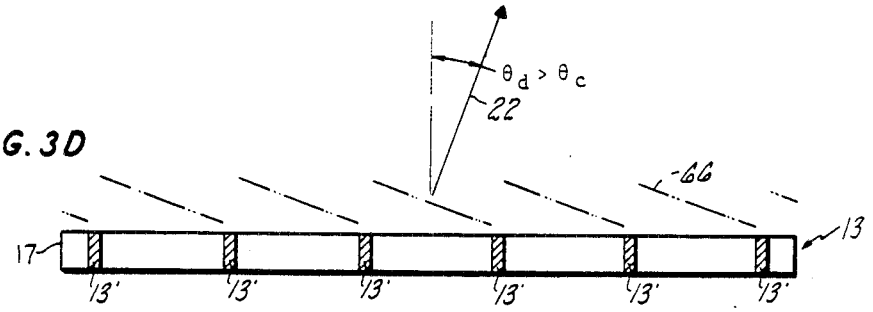

The wire electrodes 31 may be situated somewhat removed from the impedance matching layers as suggested in FIG. 2C. According to one embodiment, i.e. the one shown in FIG. 2C, they may for example be held in a mechanical frame or in a low index epoxy 33'. Alternatively, the electrodes 31 can be positioned immediately adjacent to the impedance matching layers 44 as FIG. 2B shows. The electrodes 31 can even be placed almost immediately adjacent to the ferroelectric material 17 as shown in FIG. 2A. In this instance, according to a preferred mode, the wires 31 can be deposited directly onto material 17 by well-known evaporative deposit techniques for example. The selected one of these versions of the invention, i.e. the version performing most favorably for a particular application, depends upon the nature of the field profile, fringing effects and the interaction between grid reflections.

This arrangement conducts beam steering of passing radiation 22 by inducing differential phase shifts in portions of the radiation 22 passing through the active portion of the ferroelectric material 17.

The beam steering process results from a controlled phase shift distribution created by selectively modifying the relevant refractive index, $n_o$ or $n_e$ or on intermediate value thereof, across the face of and through the bulk of the monolithic block of ferroelectric material 17. In order for this process to work, the ferroelectric material 17 must be capable of high electro-optic activity i.e. $n_o$ and $n_e$ must be capable of change under application of electric fields.

Figure 4:
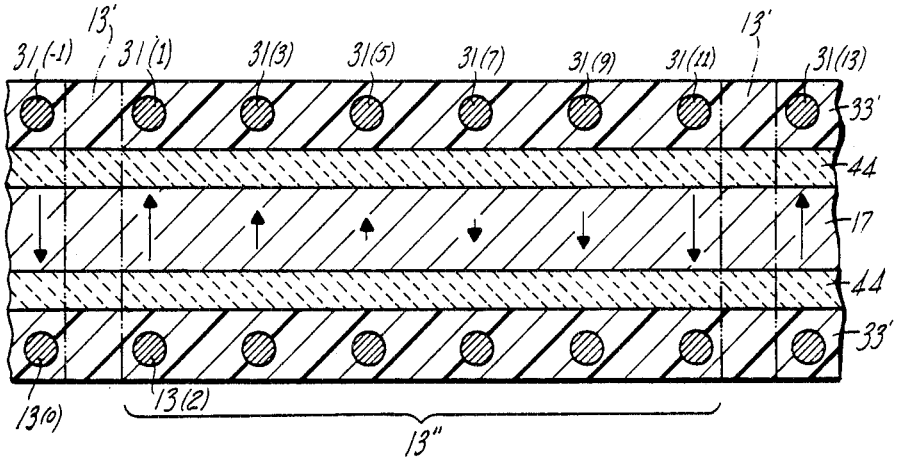
FIG. 4 is a cross-sectional schematic showing a portion of the ferroelectric material straddled by a number of grid wires to accomplish spatially varying electric field excitation of said ferroelectric material.

In order to redirect the beam of radiation 22, an electric field distribution is generated between pairs of wires 31, according to a selected scheme to be discussed below. The electric field levels established are of sufficient magnitude to cause refractive index changes in said material 17 along the field lines established by cooperating oppositely disposed pairs of wires 31. For example, wires 31(2), 31(4) and 31(6) in FIG. 4, could all be grounded by the control means, i.e. switching/addressing scheme 36, while wires 31(1), 31(3) and 31(5) are provided with progressively increasing voltage excitation levels of 1, 2, and 3 volts, for example. Alternatively, in a preferred embodiment opposite voltage levels in adjacent or opposite wires could be used to minimize the absolute value of voltage.

The switching/addressing scheme 36 can for example comprise a series of parallel individual switches each independently controllable and in series with variable resistances, thereby effective for applying variable voltage levels to wires 31. This is not shown, as it is well known. It is further not claimed as part of the invention herein. The degree or level of electric field excitation of portions of material 17 adjacent wires 31 determines the degree of refractive index change established in the adjacent portion of material 17. In particular, the phase shift due to the sustained electric field or voltage levels, can be understood as follows. Radiation in the millimeter wavelength domain divides into components upon incidence with the ferroelectric medium 17, which has a suitably aligned optic axis, in this case poled perpendicularly (i.e. "c" poled) to the face or surface of material 17. The radiation thereby exhibits polarization which is perpendicular to the optic axis (the ordinary ray), thereby altering the speed of propagation through material 17 at that portion of the ferroelectric material 17. The emerging ray has a phase shift change which is proportional to the refractive index change, times the thickness of the medium, which as already noted is sufficient to induce at least a one wavelength phase shift, i.e. two "pi" radians at one end of each affected zone 13'' of material 17.

According to the invention herein, the phase shift distribution across the aperture is modified spatially by electro-optically varying the refractive index of the medium from one side to the other. This is done by applying a sustained electric field of sufficient magnitude in an appropriate direction or in the opposite direction thereof. The electric field changes the refractive indices, $n_o$ and $n_e$ by varying amounts as is well known in the art.

Accordingly, a wave polarized orthogonally to the wires generally travels through material 17 at the speed determined by the ordinary refractive index "$n_o$", if the particular portion of material 17 is not subject to excitation with respect to portions of material 17. If on the other hand, material 17 is subject to a selected level of electric field excitation, the refractive index of the medium 17 as seen by the radiation will lie at a selected value which can be set controllably.

During electric field excitation according to this invention, the refractive index in material 17 thus varies progressively across the aperture 23, resulting in a progressively changing phase shift induced in the traversing beam 22 of millimeter wavelength radiation.

Because the upper bound on the induced phase shift is determined by the maximum amount of change possible in the refractive index, the maximum steering angle is limited in magnitude. The only requirement is that the phase shift upper bound be at least two pi radians (phase shift plus or minus pi) and this therefore establishes a basic requirement for the distance between input and output sides of the active material. In other words, material 17 must be thick enough to create a single wavelength (or two pi) phase shift at one end of the zone subject to maximum excitation.

A significant feature of this invention is the placement of ferroelectric material 17 in straddling fashion between a series of parallel wire electrodes 31 which can induce a spatially varying phase shift in throughward traversing millimeter wavelength radiation 22 by selective alteration of the refractive index of material 17, thereby altering the direction of radiating beam 22. This results in a spatially varying phase shift in the radiation beam 22 as it passes through material 17.

To reduce the effects of field fringing, the wires 31 are spaced apart at distances less than a wavelength of radiation 22. For a scanner having an aperture of M wavelengths with half-wavelength wire spacing, a total of 2 M wire pairs, each of them independently excitable, would thus be required in accordance with a preferred version of the invention.

Because an upper bound is placed on the induced phase shift by dielectric breakdown restrictions, the maximum steerage angle of beam 22 is limited as suggested in FIGS. 3A–3D. However, relatively large scan angles can be achieved by stepping the phase by two pi radians whenever the selected overall phase shift exceeds the ability of material 17 to establish a sufficient total effective phase shift to steer the beam to its desired direction.

This procedure results in the creation of sub-aperture zones being progressively smaller as the scan angle increases from $(\text{theta})_a$ to $(\text{theta})_d$. In other words, the excitation scheme repeats itself between transistion area 13' across the face of the aperture. In these transition areas 13', the electric field orientation is essentially indeterminate. It is required, however, that the phase shift established in the zones 13'' between these transistion areas 13' be at least two pi radians or an integer multiple thereof. This insures that there wil not be destructive interference between adjacent zones 13''.

In particular, to accomplish spatially varying electric field excitation in zones 13'' across the entire face or bulk of material 17 in the entire antenna aperture to a first maximum beam direction $(\text{theta})_a$ for example, a selected side of one zone 13'' of the material 17 may, for example, be subject to a selected high or low level or value of sustained electric field excitation. Progressing toward the center of each zone 13'', the level of excitation achieves an intermediate level between the high and low values. The opposite end portion of the same zone 13'' would have a correspondingly low or high level of sustained excitation.

If, according to one preferred embodiment, the selected high voltage level is positive and the selected low voltage has the same level but is negative, then at the center of each zone 13'' the excitation level will be zero.

In each case, when excitation level is spoken of herein, it is a voltage or electric field level established by opposite wires 31 of said grid electrodes 31' acting in cooperation with each other across and straddling the ferroelectric material 17 disposed therebetween. Accordingly, the excitation levels are, properly speaking, differential voltage or excitation levels.

Moreover, the ends of adjacent zones 13'' are oppositely excited. The excitation field distribution control field for steering beam 22. This control field is applied across the geography of material 17 progressively diminishing (or increasing) and then reversing itself in the direction of the opposite end of each zone 13''.

Successive adjacent regions of the material 17 are thus electrically field excited at progressively increasing levels, which nonetheless are not sufficiently high to destroy the poled state of the material 17, until a last or final region accomplishes a phase shift of two pi radians. Instead of initially electrically field-exciting the *first* section of the scanner with a low or zero value, the *last* section can be provided with the lowest or zero level of excitation, with the level of excitation increasing gradually as one comes closer and closer to the first section.

Such a gradually spatially varying excitation is for example accomplished with respect to the first portion of a first zone 13'' of material 17 between transition zones 13', for example by sustained excitation of oppositely disposed ones of wires 31 with a first selected voltage difference level as for example between wires 31(1) and 31(2). Alternatively, wire 31(1) on one side of material 17 can be provided with a selected polarity voltage excitation level, while wire 31(2) on the opposite side of material 17 is concurrently held to a predetermined voltage reference level.

Further, if wire 31(2) is high in sustained excitation, then the excitation of successive ones of positive wires 31(2) through 31(10) will decrease from wire to wire until a minimum is attained at wire 31(10). These values are with respect to an established reference. For example, all odd wires 31(1) through 31(13) could be grounded.

In this instance, wire 31(0) is next to wire 31(2) but on the other side of transition area 13'. Accordingly, the voltage or potential level at wire 31(0) would be at a low value corresponding to the high level in wire 31(2). Also, 31(12) would be at a high corresponding to the low sustained excitation level at 31(10).

An alternative, preferred scheme would oppositely excite opposite wires 31(2) and 31(1) and all other oppositely disposed wires in each of the zones, reversing polarity in the middle of each zone 13".

Accordingly, adjacent sections of material 17 would be provided with progressively lower voltage difference levels between oppositely disposed wires 31, so that the excitation level at the zone ends would suffice for the given thickness of material 17 to produce a one wavelength phase shift. At the center of a zone, the excitation difference would be zero. At the far ends of a zone 13", the excitation difference is reversed.

By so spatially exciting the scanner material between each of the several transition zones 13' indicated in FIGS. 3A-3D, which for simplicity and clarity of exposition do not show matching layers 44 and wires 31, the beam orientation can be steered by establishing phase shifts in adjacent zones 13" of material 17 which coincide and do not destructively interfere. FIGS. 3A-3D show wavefronts 66, each one wavelength, i.e. lambda, removed from the next, in the redirected electromagnetic beam 22.

Adjacent zones of progressively varying refractive index must be field excited so as not to destructively interfere, but to be two pi radians apart.

The scanner 13 is wave polarization selective, because of the presence of parallel wires 31 in the wire grid electrodes 31'. By using resistive grid wires 31 however, the electrodes 31' can pass parallel polarized radiation within an acceptable range of efficiency. This minimizes reflection of incoming beam 22.

Reflections caused by the traversal of the millimeter wavelength radiation into and out of the ferroelectric material 17 are eliminated by suitable impedance matching layers 44 disposed adjacent the input and output sides of the ferroelectric material 17. Frequently, anisotropic layers are effectively employed for impedance matching.

A radar scanner 13 of the above indicated construction is particularly compact and ultra fast in scanning operation.

By way of additional detail, the parallel wire electrodes 31' are a plurality of parallel wires 31, each in effect constituting a grid. The control means for the grid 31' and for individual one of the wires 31 is the switching and addressing scheme 36 in FIG. 1. This scheme 36 permits each one of the wires 31 to be independently addressed with a selected voltage level derived from voltage source 35 according to well known electrical techniques.

In general, the transition zones 13' referred to herein are regions of abrupt transition in the values of the sustained electric field in said ferroelectric material 17. By way of further information, the embodiment shown is predicated upon the ferroelectric material initially being poled parallel to the direction of beam 22 propagation. Thus beam 22 sees, or is affected only by the ordinary index of refraction $n_o$. This is called c-poling and works effectively for barium titanate crystals. For other ferroelectrics, a different poling direction may be used, for example, one not parallel to the direction of propagation. In this case, $n_o$ and $n_e$ come into play.

The information detailed above may lead others skilled in the art to conceive of variations thereof, which nonetheless fall within the scope of this invention. Accordingly, attention is directed toward the claims which follow, as these set forth the metes and bounds of the invention with particularly.

I claim:

1. A millimeter wavelength scanner in the path of millimeter wavelength radiation for modifying the direction of a beam of millimeter wavelength radiation passing therethrough and comprising a block of ferroelectric material with parallel input and output sides generally perpendicular with respect to the path of said millimeter wavelength radiation;

electrode means, disposed on opposite surfaces of said block of ferroelectric material, for progressively varying the refractive index of said ferroelectric material along a predetermined axis; and thereby impressing a phase change on said radiation passing therethrough and controlling means for establishing a predetermined distribution of voltage on said electrode means to vary said refractive index in a predetermined manner, characterized in that:

said electrode means includes first and second pluralities of parallel wires disposed on said opposite surfaces perpendicular to said axis;

said controlling means includes means for setting up at least two zones of adjacent wires in said electrode means with at least one transition zone therebetween and for impressing upon said at least two zones of wires a progressively changing voltage distribution corresponding to a desired phase change distribution impressed upon electromagnetic radiation traveling through said ferroelectric material; and said progressively changing voltage distribution is further characterized in that the difference in phase change between the phase change impressed in a first side of a transition zone in a first zone of said at least two zones and the phase change impressed in a second side of said transition zone in a second zone is a multiple of two pi radians, whereby said phase changes imposed on said electromagnetic radiation in said first and second zones reinforce.

2. The scanner of claim 1, further characterized in that said ferroelectric material is c-poled crystalline barium titanate.

3. A scanner according to claim 1, further characterized in that said controlling means includes means for setting up a variable number of zones and switching from a first number of zones to a second number of zones.

4. A scanner according to claim 1, further characterized in that the electric field within said ferroelectric material points in opposite directions at opposite ends of said zones, whereby said electric field is zero at an intermediate point within said zones.

* * * * *